US011958681B2

(12) United States Patent
Ni et al.

(10) Patent No.: US 11,958,681 B2
(45) Date of Patent: Apr. 16, 2024

(54) VENTILATING AND BLANKING DEVICE FOR COAL STORAGE EUROSILO

(71) Applicant: HUANENG POWER INTERNATIONAL, INC. SHANGHAI SHIDONGKOU FIRST POWER PLANT, Shanghai (CN)

(72) Inventors: Zhong Ni, Shanghai (CN); Zhiwei Sang, Shanghai (CN); Zhongming Huang, Shanghai (CN); Xin Hu, Shanghai (CN); Pengxia Ni, Shanghai (CN); Ping Zhu, Shanghai (CN); Qinghan Zheng, Shanghai (CN); Runhan Liu, Shanghai (CN); Xiao Zhang, Shanghai (CN); Jinxin Yu, Shanghai (CN); Haifeng Guan, Shanghai (CN); Jialei Deng, Shanghai (CN)

(73) Assignees: HUANENG POWER INTERNATIONAL, INC., Shanghai (CN); SHANGHAI SHIDONGKOU FIRST POWER PLANT, Shanghai (CN)

( * ) Notice: Subject to any disclaimer, the term of this patent is extended or adjusted under 35 U.S.C. 154(b) by 479 days.

(21) Appl. No.: 17/316,694

(22) Filed: May 10, 2021

(65) Prior Publication Data

US 2022/0306377 A1 Sep. 29, 2022

(30) Foreign Application Priority Data

Mar. 23, 2021 (CN) ..... 202110309590.6

(51) Int. Cl.
*B65D 88/74* (2006.01)
*E04H 7/24* (2006.01)

(52) U.S. Cl.
CPC ..... *B65D 88/742* (2013.01); *B65D 88/745* (2013.01); *E04H 7/24* (2013.01); *B65D 2588/74* (2013.01); *B65D 2588/743* (2013.01)

(58) Field of Classification Search
CPC ..... B65D 88/742; B65D 88/745; B65D 2588/743; A01F 25/22
See application file for complete search history.

(56) References Cited

U.S. PATENT DOCUMENTS 9,028,750 B2 * 5/2015 Fernandez ..... A01M 13/003 422/298
9,784,378 B1 * 10/2017 Fuehrer ..... F16K 15/035

FOREIGN PATENT DOCUMENTS

CN 110521404 A * 12/2019
WO WO-2017207817 A1 * 12/2017

* cited by examiner

*Primary Examiner* — Allen R. B. Schult
(74) *Attorney, Agent, or Firm* — Winston Hsu

(57) ABSTRACT

The present invention relates to a ventilating and blanking device for a coal storage Eurosilo. The ventilating and blanking device includes a top blanking pipe, an axial flow fan and a baffle door, the top blanking pipe including a first pipeline and a second pipeline, an air supply pipe is connected to a side wall of the second pipeline, and the baffle door is connected to a driving mechanism; during blanking, the driving mechanism drives the baffle door so as to make the baffle door close the air supply pipe and the axial flow fan is shut off; and during ventilation, the driving mechanism drives the baffle door so as to make the baffle door close the first pipeline, and the axial flow fan is turned on. Compared with the prior art, the present invention has the advantages of ventilation efficiency, good ventilation effect, etc.

9 Claims, 4 Drawing Sheets

VENTILATING AND BLANKING DEVICE FOR COAL STORAGE EUROSILO

BACKGROUND OF THE INVENTION

1. Field of the Invention

The present invention relates to a coal storage technology, and particularly relates to a ventilating and blanking device for a coal storage Eurosilo.

2. Description of the Prior Art

As shown in FIG. 6, Eurosilo coal storage is the latest domestic environmental protection coal storage method, since foreign Eurosilo coal storage uses a coal type greatly different from the domestic coal type, the foreign coal type has lower water content, less water vapor volatilizes during coal storage, in an actual coal storage process, the vapor concentration in the Eurosilo is lower, which will not influence the environment in the Eurosilo, however, the coal type used in domestic is mainly lignite, which is high in coal powder particle ratio, volatile matter and water content and prone to spontaneous combustion, accordingly, a silo body 16 of the Eurosilo will produce a higher vapor concentration, the water vapor with the higher concentration condense into water droplets when encountering an apparatus in the silo body 16 and a metal structure of the silo body 16, the water droplets are then combined with various coal-released gases in the silo body 16 to produce various acidic corrosive substances, and the acidic corrosive substances will be attached to the surface of the metal apparatus, which is not conducive to metal apparatus rust prevention; and in addition, the current domestic power generation enterprises generally use coal with higher volatile matter, volatile volume is larger, the coal volatilizes more methane and carbon monoxide during storage, and these flammable gases gather in the Eurosilo, easily causing a variety of fires, or endangering the personal safety of the maintenance men and operators going into the silo.

The domestic power generation enterprises generally use the coal prone to spontaneous combustion, for coal storage safety, nitrogen is needed to stop the oxidation reaction of the coal, a large amount of nitrogen is released from the bottom of the silo body 16 of the Eurosilo, allowing the nitrogen to fill the gap between coal particles for isolating the oxygen around the coal and reducing the possibility of oxidation reactions, however, in this way, it is inevitable that some nitrogen gas permeates out from the coal accumulated in the silo and spreads into a space without coal in the silo body 16, which will also make the oxygen content of the space without coal in the silo body 16 reduced, when personnel need to enter the silo body 16 for apparatus maintenance or operation, they will have a risk of asphyxiation due to too low oxygen concentration, except for conventional positive pressure respirators, other types of masks mostly cannot effectively protect the normal breathing of workers, but after wearing the positive pressure respirator, the worker has limited mobility and cannot meet the normal operating requirements.

As shown in FIG. 8, although the silo top 26 of the Eurosilo is equipped with a top fan 10, the Eurosilo is not a sealed container, there are many gaps in many structural combinations, for example, the position between silo top 26 and the silo body 16, of the Eurosilo, since the flow of gas occurs from a place with the least resistance, the gas outside the silo body 16 enters the silo body 16 from the gap, then flow to the top fan 10, and is discharged by the top fan 10, so the top fan 10 mainly discharges the gas around the nearby area, while the gas, near a coal pile, in the silo body 16 flows relatively slowly, the water vapor and various gases in the silo body 16 of the Eurosilo are mainly concentrated in the vicinity of the upper surface of the coal pile at the bottom of the silo body 16, the actual exhaust effect of the top fan 10 is not good, especially when the coal pile in the Eurosilo has low height, that is, when the amount of coal stored is less, the surface of the coal pile is far away from the silo top 26, it will take at least 10 hours to completely replace the gas in the silo body, in addition, if the exhaust volume of the top fan 10 is greater than the amount of air entering the silo body 16 from the gap, a negative pressure is formed in the silo, causing a load on the silo top 26, and bringing hidden dangers to the safety of the Eurosilo coal storage, meanwhile, the gas near the coal pile cannot effectively flow near the silo top 26, the air cannot be effectively changed, accordingly, the timeliness of silo operation by the personnel is seriously restricted, and this situation seriously influences the normal operation of the Eurosilo coal storage.

SUMMARY OF THE INVENTION

The objective of the present invention is to overcome the defect existing in the prior art and to provide a ventilating and blanking device for a coal storage Eurosilo, a central telescopic blanking pipe extending from an upper portion of the Eurosilo to a center in the vicinity of a surface of a coal pile in the Eurosilo serves as a channel conveying air and may rapidly and effectively discharge gas in the vicinity of the coal pile in the Eurosilo, which effectively solves a ventilation problem generated during coal storage of the Eurosilo, and has high ventilation efficiency, good ventilation effect, simple structure, convenient arrangement and low cost.

The objective of the present invention may be achieved by the following technical solutions:

A silo body of the Eurosilo is provided with a rotary trestle, a winch lifting mechanism, a trestle traveling mechanism, a center bearing, a central telescopic blanking pipe and a spiral frame, wherein the spiral frame is provided with a screw conveyor, a silo top of the Eurosilo is provided with a coal conveying trestle, the coal conveying trestle is internally provided with a feeding conveyor, coal is conveyed to a top blanking pipe by means of the feeding conveyor, the coal falls from an outlet of the top blanking pipe to a feeding port, located on the silo top, of an upper portion of the central telescopic blanking pipe, the coal sequentially passes through the central telescopic blanking pipe, a flow guide cover and a flow guide groove and then is pushed out and flattened by means of the spiral frame, the rotary trestle is driven by the trestle traveling mechanism to do circular motion on an annular rail of the silo body, the spiral frame is hung on the rotary trestle by means of a hoist rope, the spiral frame rotates along with rotation of the rotary trestle, and meanwhile, the hanging hoist rope makes the spiral frame do lifting motion by means of the winch mechanism, so as to make the position of the spiral frame changed along with a height of the pile; and the central telescopic blanking pipe is formed by concentrically connecting several sections of round pipes with different diameters, two ends of each section of round pipe are provided with steps with different diameters, accordingly, two adjacent sections of round pipes may hook each other and meanwhile may slide relatively in an axial direction of the round pipes, the several sections of round pipes are connected on one axis and extends or retracts section by section along with increase or shortening of a distance between the two ends of the central telescopic blanking pipe, in this way, the distance between the two ends of the central telescopic blanking pipe may be changed along with a distance between the rotary trestle and the spiral frame to guarantee that the coal travels in the central telescopic blanking pipe all the time, and an inner diameter of the central telescopic blanking pipe ranges from 1.1 m to 1.4 m.

A ventilating and blanking device for a coal storage Eurosilo includes a top blanking pipe, an axial flow fan and a baffle door, the top blanking pipe including a first pipeline and a second pipeline, wherein one end of the second pipeline is connected to an outlet end of the first pipeline, the other end of the second pipeline is connected to the central telescopic blanking pipe, an air supply pipe is connected to a side wall of the second pipeline, the axial flow fan is arranged at an inlet end of the air supply pipe, and the baffle door is movably arranged in the second pipeline and connected to a driving mechanism;

during feeding, the driving mechanism drives the baffle door so as to make the baffle door close the air supply pipe, the axial flow fan is shut off, and at the moment, a channel from the inlet end of the first pipeline to the outlet end of the second pipeline is in an open state, the coal sequentially passes through the first pipeline, the second pipeline and the central telescopic blanking pipe and falls into the silo body; and during ventilation, the driving mechanism drives the baffle door so as to make the baffle door close the first pipeline, at the moment, a channel from the inlet end of the air supply pipe to the outlet end of the second pipeline is in an open state, the axial flow fan is turned on, the outlet end of the central telescopic blanking pipe extends near the coal pile, meanwhile, air outside the silo body sequentially passes through the axial flow fan, the air supply pipe, the second pipeline, the central telescopic blanking pipe and the flow guide groove and then enters the silo body, due to the fact that the outlet end of the central telescopic blanking pipe is close to the coal pile, an air flowing speed in the vicinity of the coal pile in the silo body is increased, original air may be rapidly and completely replaced, time needed by air replacement in the silo body is greatly shortened, an effect of air replacement is improved, and meanwhile, the flow guide groove located at the outlet end of the central telescopic blanking pipe rotates along with the rotation of the rotary trestle, and then the air, outside the silo body, getting out of the flow guide groove may further diffuse in a peripheral direction, which further increases the air flowing speed and improves the replacement effect.

Further, the baffle door is movably arranged in the second pipeline by means of a baffle door shaft, the driving mechanism comprises an electric push rod, the electric push rod being arranged on an outer side wall of the second pipeline by means of a support, a telescopic push rod of the electric push rod being connected to a rocker arm, and an end of the baffle door shaft penetrating the side wall of the second pipeline and being connected to the rocker arm, and the second pipeline is provided with two proximity sensors for detecting a position of the rocker arm, the proximity sensors, the axial flow fan and the electric push rod being connected to a controller;

during feeding, the telescopic push rod of the electric push rod resets and drives the baffle door shaft by means of the rocker arm to rotate, at the moment, the baffle door rotates downwards with the baffle door shaft as an axis, the baffle door shaft closes the air supply pipe, meanwhile, one of the proximity sensors detects a first position signal of the rocker arm and send it to the controller, which shows that the feeding conveyor has a start conveying condition, and at the moment the controller may control the feeding conveyor to turn on; and during ventilation, the telescopic push rod of the electric push rod extends out and drives the baffle door shaft by means of the rocker arm to rotate, at the moment, the baffle door rotates upwards with the baffle door shaft as an axis, the baffle door shaft closes the first pipeline, meanwhile, the other proximity sensors detects a second position signal of the rocker arm and send it to the controller, which shows that the axial flow fan has a start air supply condition, and at the moment the controller may control the axial flow fan to turn on.

Further, two sides of the baffle door are both provided with cone-shaped bosses, the bosses matching the outlet end of the first pipeline and the outlet end of the air supply pipe, the outlet end of the first pipeline is provided with a first flexible seal ring, the outlet end of the air supply pipe is provided with a second flexible seal ring, when the baffle door seals the first pipeline or the air supply pipe, the boss is inserted into the outlet end of the first pipeline or the air supply pipe, meanwhile, an inclined plane of the boss supports the first flexible seal ring or the second flexible seal ring correspondingly, the first flexible seal ring or the second flexible seal ring is tightly combined with the inclined plane of the boss, the airtightness is good, material or gas leakage is prevented, and meanwhile, due to flexible contact, under the condition that proximity sensor detection has signal delay, resulting in not timely stopping the electric push rod, no damage is caused to the apparatus structure, the safety is good, and the service life is long.

Further, the first pipeline has a circular truncated cone shape, which is beneficial to expanding an area of the inlet end of the first pipeline for blanking.

Further, the outlet end of the second pipeline is provided with a flange plate, which is beneficial to connecting the second pipeline and the central telescopic blanking pipe.

Compared with the prior art, the present invention has the following beneficial effects:

(1) The top blanking pipe includes the first pipeline and the second pipeline, two ends of the second pipeline are connected to the first pipeline and the central telescopic blanking pipe separately, the second pipeline is connected to the air supply pipe, the end of the air supply pipe is provided with the axial flow fan, the baffle door is movably arranged in the second pipeline and connected to the driving mechanism, the first pipeline and the air supply pipe are controlled to be connected by means of the baffle door, meanwhile, the axial flow fan is turned on during ventilation, the outlet end of the central telescopic blanking pipe extends near the coal pile, the air outside the silo body sequentially passes through the axial flow fan, the air supply pipe, the second pipeline, the central telescopic blanking pipe and the flow guide groove and then enters the silo body, due to the fact that the outlet end of the central telescopic blanking pipe is close to the coal pile, the air flowing speed in the vicinity of the coal pile in the silo body is increased, the gas in the vicinity of the coal pile is forced to be discharged from various structural gaps of the silo body or the top fan at the silo top, the original air may be rapidly and completely replaced, time needed by air replacement in the silo body is greatly shortened, an effect of air replacement is improved, the problem of ventilation of the Eurosilo during lignite storage may be effectively solved, the adaptability of the Eurosilo to different coal type is improved, the corrosion action of various acidic corrosion materials, formed after the combination of gas and water in the silo body, on the silo body structure and the apparatus may be effectively reduced, the service life of the apparatus of the silo body structure is prolonged, coal storage safety and normal operation by the personnel entering the silo are guaranteed, and meanwhile, in combination with the structural features of the Eurosilo, a bearing load of the original apparatuses of the Eurosilo does not need to be changed, the structure is simple, arrangement is convenient, and the cost is low;

(2) The flow guide groove located at the outlet end of the central telescopic blanking pipe rotates along with the rotation of the rotary trestle, and then the air, outside the silo body, getting out of the flow guide groove may further diffuse in the peripheral direction, which further increases the air flowing speed and improves the replacement effect and meanwhile may prevent the air overflowing from the outlet end of the central telescopic blanking pipe from directly rushing for the coal pile and generating flying dust;

(3) The ventilating and blanking device controls the connection between the first pipeline and the air supply pipe by means of the driving mechanism driving the baffle door, achieves indirect detection on the position of the baffle door by means of the proximity sensor detecting the position of the rocker arm, and has high automatic degree, simple structure, low cost and easy on-site arrangement;

(4) the two sides of the baffle door are both provided with the cone-shaped bosses, the bosses matching the outlet end of the first pipeline and the outlet end of the air supply pipe, the outlet end of the first pipeline is provided with the first flexible seal ring, the outlet end of the air supply pipe is provided with the second flexible seal ring, the first flexible seal ring and the second flexible seal ring are made of rubber or polyurethane, when the baffle door seals the first pipeline or the air supply pipe, the boss is inserted into the outlet end of the first pipeline or the air supply pipe, meanwhile, the inclined plane of the boss supports the first flexible seal ring or the second flexible seal ring correspondingly, the first flexible seal ring or the second flexible seal ring is tightly combined with the inclined plane of the boss, the airtightness is good, material or gas leakage is prevented, and meanwhile, due to flexible contact, under the condition that proximity sensor detection has signal delay, resulting in not timely stopping the electric push rod, no damage is caused to the apparatus structure, the safety is good, and the service life is long;

(5) The first pipeline has the circular truncated cone shape, which is beneficial to expanding the area of the inlet end of the first pipeline for blanking; and (6) The outlet end of the second pipeline is provided with the flange plate, which is beneficial to connecting the second pipeline and the central telescopic blanking pipe.

These and other objectives of the present invention will no doubt become obvious to those of ordinary skill in the art after reading the following detailed description of the preferred embodiment that is illustrated in the various figures and drawings.

DETAILED DESCRIPTION

The present invention will be elaborated hereafter in conjunction with the accompanying drawings and specific embodiments. The embodiments are implemented on the premise of the technical solution of the present invention, detailed description and specific operation processes are given, but the scope of protection of the present invention is not limited to the embodiments described below.

Figure 6:
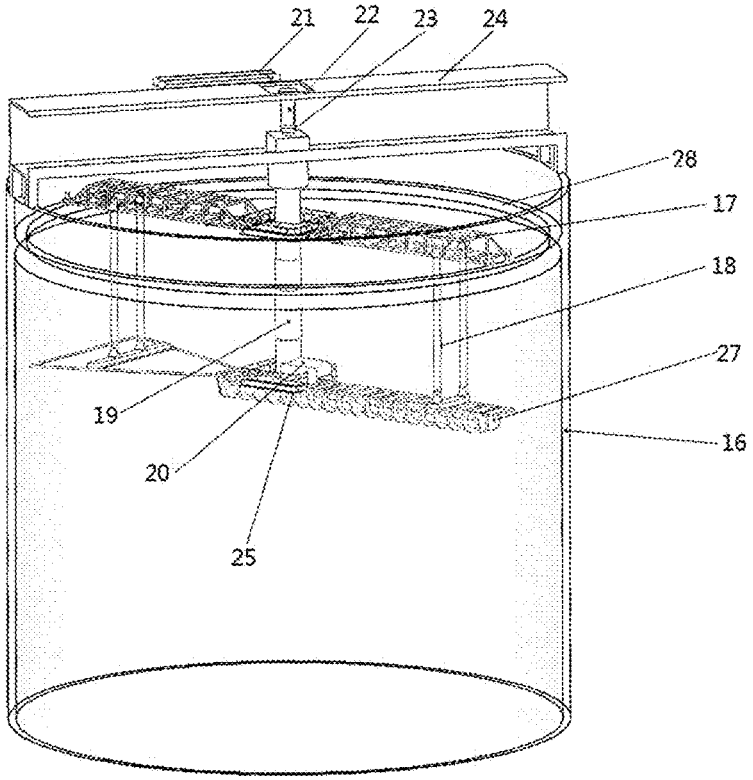
FIG. 6 is a schematic diagram of an internal structure of an Eurosilo.
Figure 9:
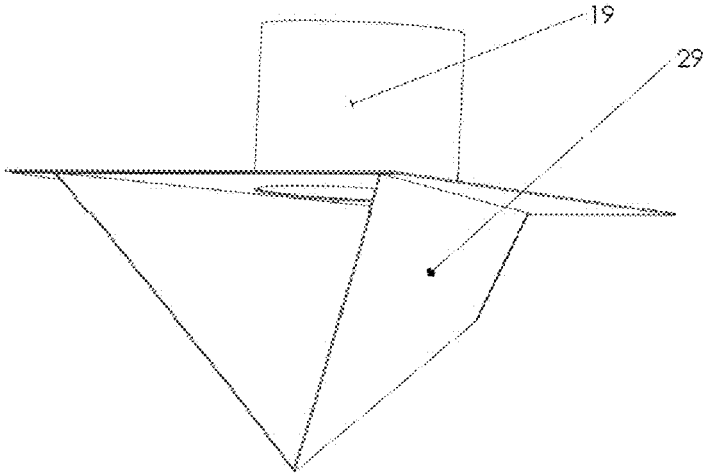
FIG. 9 is a structural schematic diagram of a material guide slide plate.

As shown in FIGS. 6 and 9, a silo body 16 of an Eurosilo is provided with a rotary trestle 17, a winch lifting mechanism, a trestle traveling mechanism, a center bearing, a central telescopic blanking pipe 19 and a spiral frame 27, wherein the spiral frame 27 is provided with a screw conveyor 25, a silo top 26 of the Eurosilo is provided with a coal conveying trestle 24, the coal conveying trestle 24 is internally provided with a feeding conveyor 21, coal is conveyed to a top blanking pipe 22 by means of the feeding conveyor 21, the coal falls from an outlet of the top blanking pipe 22 to a feeding port 23, located on the silo top 26, of an upper portion of the central telescopic blanking pipe 19, the coal sequentially passes through the central telescopic blanking pipe 19, a material guide slide plate 29 and a flow guide groove 20 and then is pushed out and flattened by means of the spiral frame 27, the rotary trestle 17 is driven by the trestle traveling mechanism to do circular motion on an annular rail 28 of the silo body 16, the spiral frame 27 is hung on the rotary trestle 17 by means of a hoist rope 18, the spiral frame 27 rotates along with rotation of the rotary trestle 17, and meanwhile, the hanging hoist rope 18 makes the spiral frame 27 do lifting motion by means of the winch mechanism, so as to make the position of the spiral frame 27 changed along with a height of the pile; and the central telescopic blanking pipe 19 is formed by concentrically connecting several sections of round pipes with different diameters, two ends of each section of round pipe are provided with steps with different diameters, accordingly, two adjacent sections of round pipes may hook each other and meanwhile may slide relatively in an axial direction of the round pipes, the several sections of round pipes are connected on one axis and extends or retracts section by section along with increase or shortening of a distance between the two ends of the central telescopic blanking pipe 19, and in this way, the distance between the two ends of the central telescopic blanking pipe 19 may be changed along with a distance between the rotary trestle 17 and the spiral frame 27 to guarantee that the coal travels in the central telescopic blanking pipe 19 all the time.

Figure 1:
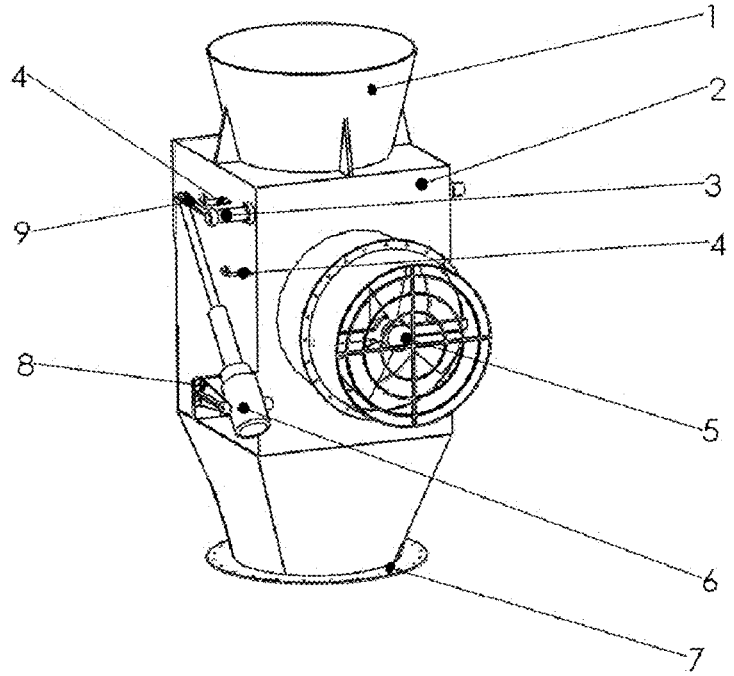
FIG. 1 is a perspective structural schematic diagram of the present invention.
Figure 2:
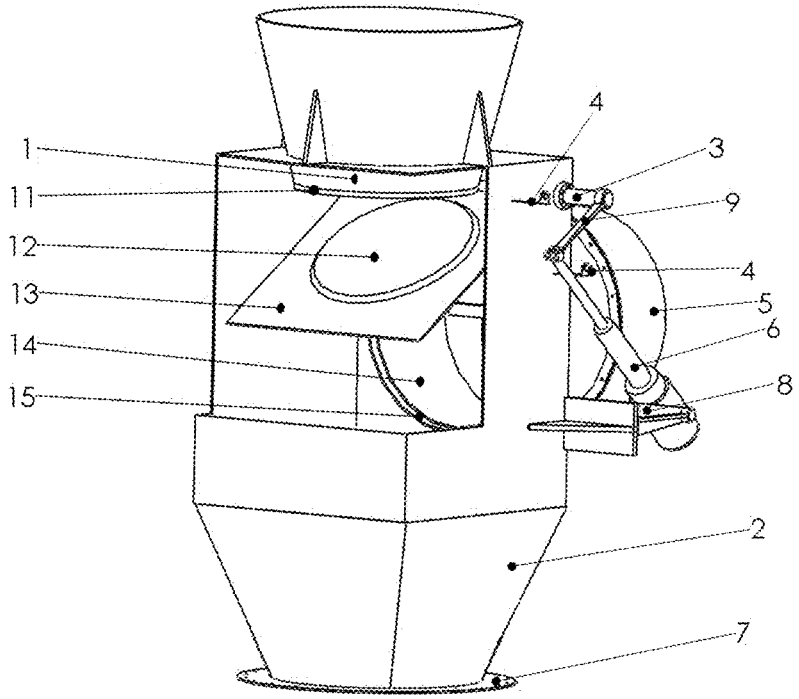
FIG. 2 is a schematic diagram of an internal structure of a second pipeline.
Figure 3:
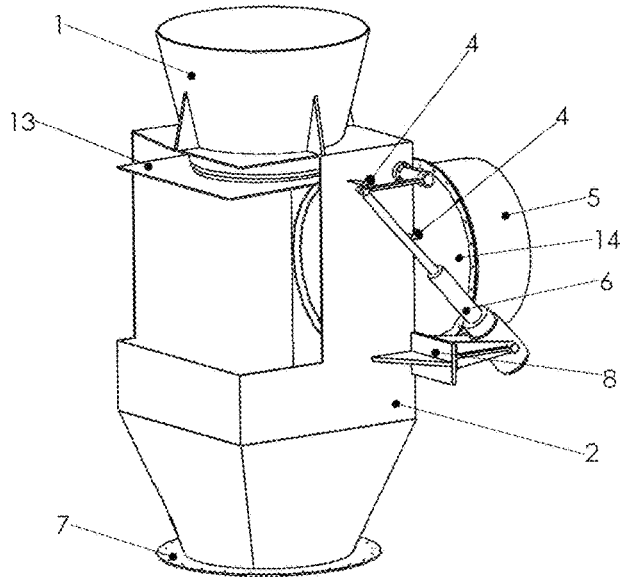
FIG. 3 is a structural schematic diagram of a first pipeline during closed, according to the present invention.
Figure 7:
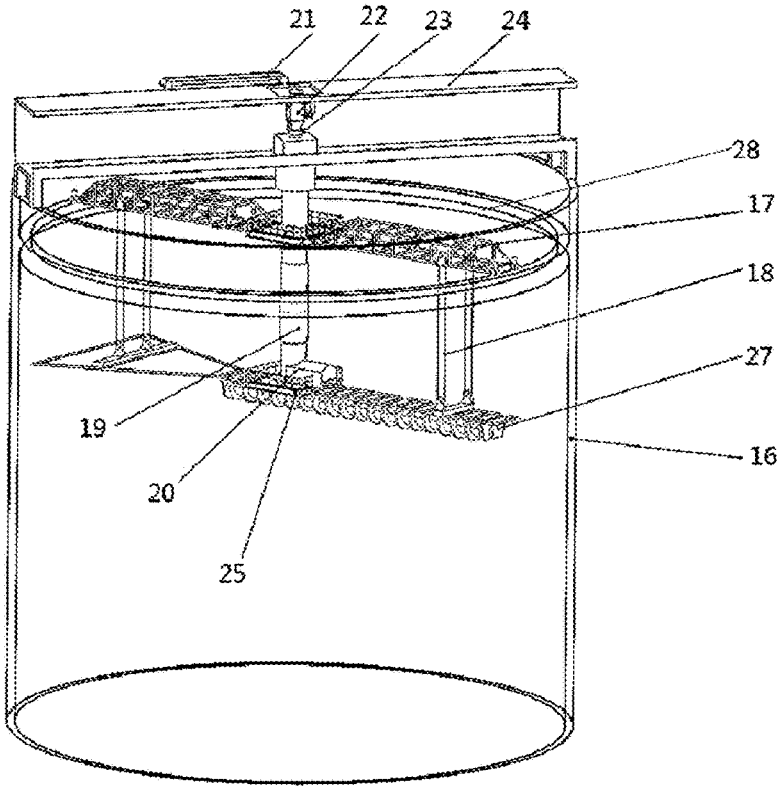
FIG. 7 is a schematic diagram of a position of the present invention on the Eurosilo.
Figure 8:
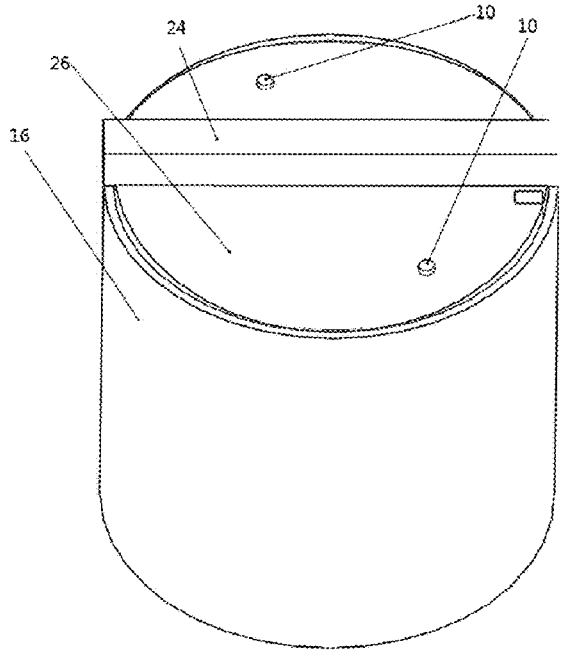
FIG. 8 is a structural schematic diagram of a top of the Eurosilo.

As shown in FIGS. 1, 3 and 7, a ventilating and blanking device for the coal storage Eurosilo includes a top blanking pipe 22, an axial flow fan 5 and a baffle door 13, the top blanking pipe 22 including a first pipeline 1 and a second pipeline 2, wherein one end of the second pipeline 2 is connected to an outlet end of the first pipeline 1, the other end of the second pipeline is connected to the central telescopic blanking pipe 19, an air supply pipe 14 is connected to a side wall of the second pipeline 2, the axial flow fan 5 is arranged at an inlet end of the air supply pipe 14, the baffle door 13 is movably arranged in the second pipeline 2 by means of the baffle door shaft 3 and connected to a driving mechanism, the driving mechanism includes an electric push rod 6, the electric push rod 6 being arranged on an outer side wall of the second pipeline 2 by means of a support 8, an output end of the electric push rod 6 being connected to a rocker arm 9, an end of the baffle door shaft 3 penetrating the side wall of the second pipeline 2 and being connected to the rocker arm 9, and the second pipeline 2 is provided with two proximity sensors 4 for detecting a position of the rocker arm 9, the proximity sensors 4, the axial flow fan 5 and the electric push rod 6 being connected to a controller.

The the first pipeline 1 has the circular truncated cone shape, which is beneficial to expanding the area of the inlet end of the first pipeline 1 for blanking.

The outlet end of the second pipeline 2 is provided with the flange plate 7, which is beneficial to connecting the second pipeline 2 and the central telescopic blanking pipe 19.

A return difference, a response time, detection frequency and repeated accuracy of proximity limitation of the proximity sensor 4 may match a boundary dimension of the rocker arm 9, a selected type of proximity limitation matches a material and an appearance color of the rocker arm 9, and a minimum distance between the proximity limitation and the rocker arm 9 should satisfy a distance requirement for triggering output of an electrical signal by proximity limitation.

Figure 4:
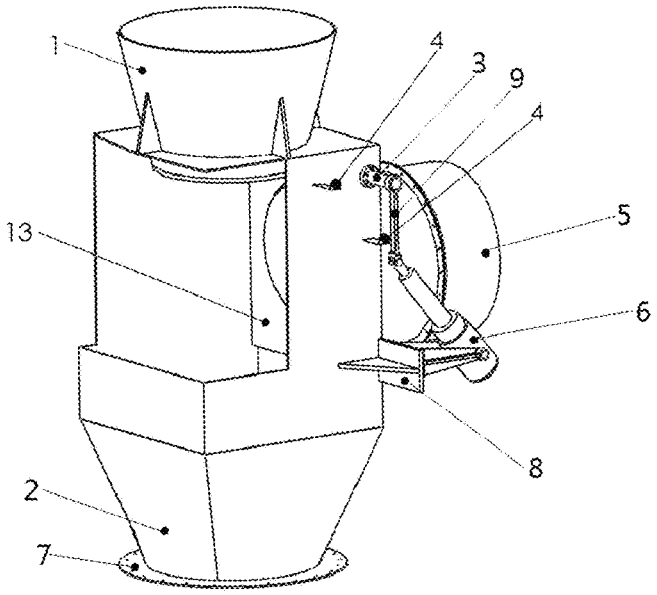
FIG. 4 is a structural schematic diagram of an air supply pipe during closed, according to the present invention.

As shown in FIG. 4, during feeding, the outlet end of the electric push rod 6 resets and drives the baffle door shaft 3 by means of the rocker arm 9 to rotate, at the moment, the baffle door 13 rotates downwards with the baffle door shaft 3 as an axis, the baffle door shaft 3 closes the air supply pipe 14, the axial flow fan 5 is shut off, at the moment, a channel from the inlet end of the first pipeline 1 to the outlet end of the second pipeline 2 is in an open state, one of the proximity sensors 4 detects a first position signal of the rocker arm 9 and send it to the controller, which shows that the feeding conveyor 21 has a start conveying condition, and at the moment the controller controls the feeding conveyor 21 to turn on, and the coal sequentially passes through the first pipeline 1, the second pipeline 2 and the central telescopic blanking pipe 19 and falls into the silo body 16; and as shown in FIG. 3, during ventilation, the outlet end of the electric push rod 6 extends out and drives the baffle door shaft 3 by means of the rocker arm 9 to rotate, at the moment, the baffle door 13 rotates upwards with the baffle door shaft 3 as an axis, the baffle door shaft 3 closes the first pipeline 1, at the moment, a channel from the inlet end of the air supply pipe 14 to the outlet end of the second pipeline 2 is in an open state, meanwhile, the other proximity sensor 4 detects a second position signal of the rocker arm 9 and send it to the controller, which shows that the axial flow fan 5 has a start air supply condition, the controller controls the axial flow fan 5 to turn on, the outlet end of the central telescopic blanking pipe 19 extends near the coal pile, meanwhile, air outside the silo body 16 sequentially passes through the axial flow fan 5, the air supply pipe 14, the second pipeline 2, the central telescopic blanking pipe 19, the material guide slide plate 29 and the flow guide groove 20 and then enters the silo body 16, due to the fact that the outlet end of the central telescopic blanking pipe 19 is close to the coal pile, an air flowing speed in the vicinity of the coal pile in the silo body 16 is increased, original air may be rapidly and completely replaced, time needed by air replacement in the silo body 16 is greatly shortened, an effect of air replacement is improved, and meanwhile, the flow guide groove 20 located at the outlet end of the central telescopic blanking pipe 19 rotates along with the rotation of the rotary trestle 17, and then the air, outside the silo body 16, getting out of the flow guide groove 20 may further diffuse in a peripheral direction along with the material conveying direction of the material guide slide plate, which further increases the air flowing speed and improves the replacement effect and meanwhile may prevent the air overflowing from the outlet end of the central telescopic blanking pipe 19 from directly rushing for the coal pile and generating flying dust.

Figure 5:
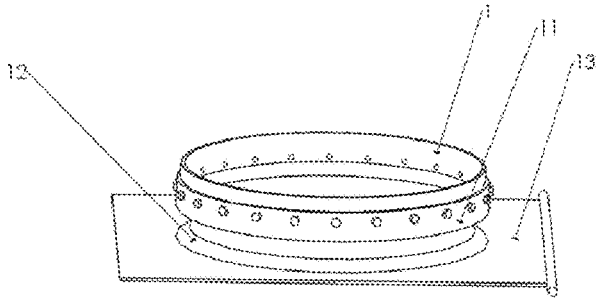
FIG. 5 is a structural schematic diagram of a first flexible seal ring.
Figure 10:
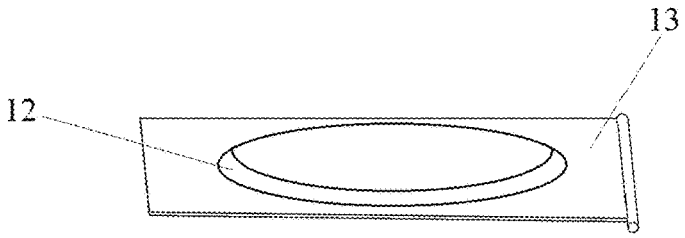
FIG. 10 is a structural schematic diagram of a baffle door.

As shown in FIGS. 5 and 10, the two sides of the baffle door 13 are both provided with the cone-shaped bosses 12, the bosses 12 matching the outlet end of the first pipeline 1 and the outlet end of the air supply pipe 14, the outlet end of the first pipeline 1 is provided with the first flexible seal ring 11, the outlet end of the air supply pipe 14 is provided with the second flexible seal ring 15, the first flexible seal ring 11 and the second flexible seal ring 15 are made of rubber or polyurethane, when the baffle door 13 seals the first pipeline 1 or the air supply pipe 14, the boss 12 is inserted into the outlet end of the first pipeline 1 or the air supply pipe 14, meanwhile, the inclined plane of the boss 12 supports the first flexible seal ring 11 or the second flexible seal ring 15 correspondingly, the first flexible seal ring 11 or the second flexible seal ring 15 is tightly combined with the inclined plane of the boss 12, the airtightness is good, material or gas leakage is prevented, and meanwhile, due to flexible contact, under the condition that proximity sensor 4 detection has signal delay, resulting in not timely stopping the electric push rod 6, no damage is caused to the apparatus structure, the safety is good, and the service life is long.

Provided in the present invention is a ventilating and blanking device for a coal storage Eurosilo, in combination with the features of the Eurosilo and the feeding conveyor 21, the telescopic coal blanking pipe 19 arranged on the axis of the silo body 16 by the Eurosilo is used for ventilation, a bearing load of the original apparatuses of the Eurosilo does not need to be changed, the axial flow fan 5 has lower energy consumption and may send fresh air larger than 20000 $Nm^3/h$ outside the silo into the area in the vicinity of the coal pile in the silo, then disperse water vapor, volatilized gas volatilized from various coal or nitrogen used for coal inerting, and force the gas to be discharged from various structural gaps of the silo body 16 or the top fan 10 at the silo top 26, which plays a role in rapid replacement of the gas in the silo body 16, since the air is directly supplied near the upper surface of the coal pile in the silo, the ventilation effect is obvious, the problem of ventilation of the Eurosilo during lignite storage may be effectively solved, the adaptability of the Eurosilo to different coal types is improved, the corrosion action of various acidic corrosion materials, formed after the combination of gas and water in the silo body 16, on the silo body structure and the apparatus may be effectively reduced, the service life of the apparatus of the silo body structure is prolonged, coal storage safety and normal operation by the personnel entering the silo are guaranteed;

when the axial flow fan 5 works, a small amount of the conveyed air may overflow from a joint between the sections of the central telescopic blanking pipe 19, but the overflowing air still spreads into the Eurosilo, 80% of the air may be conveyed to the bottom of the central telescopic blanking pipe 19, gets out of the outlet of the central telescopic blanking pipe 19 and then diffuses in the area in the vicinity above the surface of the coal pile in the silo, and since the conveyed air outside the silo has a lower temperature than that of the gas in the silo, the gas in the silo is lifted up more easily, which improves the efficiency of air replacement in the silo; and meanwhile, the ventilating and blanking device controls the connection between the first pipeline 1 and the air supply pipe 14 by means of the driving mechanism driving the baffle door 13, achieves indirect detection on the position of the baffle door 13 by means of the proximity sensor 4 detecting the position of the rocker arm 9, and has high automatic degree, simple structure, low cost and easy on-site arrangement.

A preferred embodiment of the present invention is described in detail above. It should be understood that many modifications and variations can be made according to the conception of the present invention by those ordinary skill in the art without creative effort. Therefore, any technical solution that those skilled in the art can obtain by logical analysis, reasoning or limited experiment on the basis of the prior art according to the conception of the present invention shall fall within the scope of protection determined by the claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A ventilating and blanking device for a coal storage silo, comprising a top blanking pipe, and further comprising an axial flow fan and a baffle door, the top blanking pipe comprising a first pipeline and a second pipeline, wherein an inlet end of the second pipeline is connected to an outlet end of the first pipeline, an air supply pipe is connected to a side wall of the second pipeline, the axial flow fan is arranged at an inlet end of the air supply pipe, an outlet end of the second pipeline is connected to a central telescopic blanking pipe of the silo, two sides of the baffle door are both provided with bosses, the bosses match the outlet end of the first pipeline and the outlet end of the air supply pipe, and the baffle door is movably arranged in the second pipeline and connected to a driving mechanism;

during feeding, the driving mechanism drives the baffle door so as to make the baffle door close the air supply pipe, and the axial flow fan is shut off; and during ventilating and blanking, the driving mechanism drives the baffle door so as to make the baffle door close the first pipeline, and the axial flow fan is turned on.

2. The ventilating and blanking device for the coal storage silo according to claim 1, wherein the baffle door is movably arranged in the second pipeline by means of a baffle door shaft.

3. The ventilating and blanking device for the coal storage silo according to claim 2, wherein the driving mechanism comprises an electric push rod, the electric push rod being arranged on an outer side wall of the second pipeline by means of a support, an output end of the electric push rod being connected to a rocker arm, and an end of the baffle door shaft penetrating the side wall of the second pipeline and being connected to the rocker arm.

4. The ventilating and blanking device for the coal storage silo according to claim 3, wherein the second pipeline is provided with two proximity sensors for detecting a position of the rocker arm.

5. The ventilating and blanking device for the coal storage silo according to claim 1, wherein the bosses each has a cone shape.

6. The ventilating and blanking device for the coal storage silo according to claim 1, wherein the outlet end of the first pipeline is provided with a first flexible seal ring.

7. The ventilating and blanking device for the coal storage silo according to claim 1, wherein the outlet end of the air supply pipe is provided with a second flexible seal ring.

8. The ventilating and blanking device for the coal storage silo according to claim 1, wherein the first pipeline has a circular truncated cone shape.

9. The ventilating and blanking device for the coal storage silo according to claim 1, wherein the outlet end of the second pipeline is provided with a flange plate.

* * * * *